United States Patent [19]

Fitch et al.

[11] Patent Number: 4,510,997

[45] Date of Patent: Apr. 16, 1985

[54] SOLVENT FLOODING TO RECOVER VISCOUS OILS

[75] Inventors: John L. Fitch, Dallas; Lynn D. Mullins, De Soto, both of Tex.

[73] Assignee: Mobil Oil Corporation, New York, N.Y.

[21] Appl. No.: 544,814

[22] Filed: Oct. 25, 1983

Related U.S. Application Data

[63] Continuation of Ser. No. 308,755, Oct. 5, 1981, abandoned.

[51] Int. Cl.[3] ..... E21B 43/22

[52] U.S. Cl. ..... 166/263; 166/50; 166/274

[58] Field of Search ..... 166/50, 263, 268, 272, 166/274

[56] References Cited

U.S. PATENT DOCUMENTS

| | | | |
|---|---|---|---|
| 3,295,601 | 1/1967 | Santourian | 166/273 X |
| 4,019,577 | 4/1977 | Fitch et al. | 166/50 X |
| 4,022,279 | 5/1977 | Driver | 166/303 X |
| 4,026,358 | 5/1977 | Allen | 166/261 |
| 4,207,945 | 6/1980 | Hall et al. | 166/263 X |
| 4,249,777 | 2/1981 | Morrell et al. | 166/50 X |
| 4,296,969 | 10/1981 | Willman | 166/50 X |
| 4,385,662 | 5/1983 | Mullins et al. | 166/263 |

*Primary Examiner*—George A. Suchfield

*Attorney, Agent, or Firm*—A. J. McKillop; M. G. Gilman; L. O. Miller

[57] ABSTRACT

Oil may be recovered from viscous oil-containing formations including tar sand deposits by providing at least one injection well and at least one spaced-apart production well which extend downwardly from the surface and which extend to, and generally horizontally through, the bottom of the oil-containing formation with fluid communication of the horizontally extending portions of each well with the oil-containing formation. A predetermined amount of solvent, preferably 0.05 to 0.30 pore volume is injected into the bottom of the formation via the injection well and fluids including oil are recovered from the formation via the production well. After the desired amount of solvent has been injected into the formation, production is terminated and both the injection well and production well are shut-in to allow the formation to undergo a soak period for a variable time, preferably for a time between 2 to 20 days per foot of vertical thickness of the oil-containing formation. During the soak period, there is substantial mixing of the heavy oil and the solvent in the formation by gravity-driven convection wherein the viscosity of the heavy oil is reduced, thereby making it easier to produce. A driving fluid such as water is then injected into the formation via the injection well and oil of reduced viscosity is produced until there is an unfavorable amount of driving fluid, preferably at least 90 percent.

7 Claims, 3 Drawing Figures

SOLVENT FLOODING TO RECOVER VISCOUS OILS

This is a continuation of copending application Ser. No. 308,755 filed on Oct. 5, 1981 now abandoned.

BACKGROUND OF THE INVENTION

1. Field of the Invention

This invention is directed to a method of recovering oil from viscous oil-containing subsurface formations. More particularly, this invention is directed to a hydrocarbon solvent recovery method for recovering oil from subsurface formations that are penetrated by at least one injection well and one production well which extend downwardly from the surface of the earth into the bottom of the oil-containing formation and then extend horizontally through the formation.

2. Description of the Prior Art

In co-pending application filed July 21, 1981, Ser. No. 285,696, now U.S. Pat. 4,373,585, to Fitch et al., there is disclosed a method of recovering viscous oil from a viscous oil-containing formation wherein a selected solvent is injected into a fluid communication path in the lower portion of the formation intermediate at least an injection well and a production well. A hydrocarbon solvent having a density less than oil contained in the formation and a viscosity not greater than 1/100 the viscosity of the oil contained in the formation under formation conditions is injected into the communication path and fluids including oil are recovered from the production well until the fluid recovered contains an unfavorable ratio of oil to solvent. The production well is shut-in and an additional quantity of the hydrocarbon solvent is injected into the fluid communication path, preferably until a total amount of between 0.05 to 0.30 pore volume has been injected. The injection well is then shut-in along with the production well to permit the formation to undergo a soak period for a variable time, preferably for a time of between 2 to 20 days per vertical thickness in feet of oil-containing formation. A driving fluid such as water is then injected into the formation via the injection well and the oil is produced until there is an unfavorable ratio of oil to driving fluid. During the fluid drive recovery phase, the injection well and production well may be completed to be in fluid communication with the entire portion of the formation to obtain a more uniform displacement of the solvent and oil mixture in the formation by the driving fluid.

In co-pending application Ser. No. 46,275, now U.S. Pat. No. 4,293,035, filed June 7, 1979, to John L. Fitch, there is disclosed a method of recovering viscous oil from the viscous oil bearing subsurface formation wherein a solvent is injected into a high mobility channel formed in the bottom of the formation intermediate an injection well and a production well. The solvent is injected until the ratio of produced oil to solvent becomes unfavorable and thereafter the injection of solvent is terminated and gas is injected into the high mobility channel to produce solvent and oil from the formation.

In U.S. Pat. No. 3,838,738 there is described a method for recovering viscous petroleum from petroleum-containing formations by first establishing a fluid communication path low in the formation. A heated fluid is then injected into the fluid communication path followed by injecting a volatile solvent such as carbon disulfide, benzene or toluene into the preheated flow path and continuing injecting the heated fluid and recovering fluids including petroleum from the production well.

In U.S. Pat. No. 3,500,917 there is disclosed a method for recovering crude oil from an oil-bearing formation having a water-saturated zone underlying the oil-saturated zone. A mixture of an aqueous fluid which has a density greater than the density of the crude oil and a solvent having a density less than the density of the crude oil are injected into the water-saturated zone and oil is produced from the formation.

U.S. Pat. No. 4,026,358 discloses a method for recovering heavy oil from a subterranean hydrocarbon-bearing formation traversed by at least one injection well and one production well wherein a slug of hydrocarbon solvent in amounts of 0.1 to about 20 percent of the formation pure volume and having a gas dissolved therein is injected into the formation via the injection well. Thereafter, a thermal sink is created in the formation by in-situ combustion or by injecting steam. The wells are then shut-in for a predetermined time to permit the formation to undergo a soak period, after which production is continued. Optionally, after the production period, the formation may be water flooded to recover additional oil from the formation.

SUMMARY OF THE INVENTION

This invention is directed to a method of recovering viscous oil from a viscous oil-containing formation that has no significant vertical permeability barrier in the portion of the formation being produced involving at least one injection well and at least one spaced-apart production well that vertically penetrate the formation and then extend horizontally through the bottom of the formation for injection of a predetermined amount of solvent into the formation and recovery of oil from the formation. The injection well and production well are drilled into the formation extending downwardly from the earth's surface to the bottom of the oil-containing formation and then a substantial distance through the formation in a generally horizontal direction. That portion of the injection well and production well that extends horizontally through the bottom of the formation is perforated or otherwise equipped to provide fluid communication between both wells and the formation. The production well is spaced-apart from the injection well but the horizontal portion of the production well is at the same level as, and parallel to, the horizontal portion of the injection well. A predetermined amount of hydrocarbon solvent having a viscosity not greater than 1/100 the viscosity of the oil contained in the formation and a specific gravity less than the oil contained in the formation under formation conditions, is injected into the bottom of the formation via the injection well and fluids including oil are recovered from the production well. The amount of solvent injected is preferably 0.05 to 0.30 pore volume. After the desired amount of solvent has been injected into the formation, production is terminated and both the injection well and production well are shut-in to permit the formation to undergo a soak period for a variable time, preferably for a period of time between 2 to 20 days per foot of vertical thickness of the oil-containing formation. During this soak period, the light hydrocarbon solvent will tend to rise and the heavy oil will move downward in a gravity-driven convection process forming a pattern of fingers. This fingering causes an effective contact between the oil and solvent thus providing a greater volume of oil that is reduced in viscosity thereby increasing the rate of oil recovery. Thereafter, a driving fluid such as water is injected into the injection well to displace the oil of reduced viscosity toward the production well for recovery. Production is continued until the oil recovered from the production well contains an unfavorable amount of driving fluid, preferably at least 90 percent.

DESCRIPTION OF THE PREFERRED EMBODIMENTS

The invention relates to a hydrocarbon solvent recovery method for recovering viscous oil from a viscous oil-containing subsurface formation that has no significant vertical permeability barrier in the portion of the formation to be treated utilizing injection and production wells which extend from the earth's surface downwardly into the oil-containing formation and then extend horizontally through the lower portion of the oil formation. Viscous oil is a term used to identify oil having relatively high viscosity and includes those oils referred to as tars. Such viscous oils are also referred to as heavy oils. In general, the term viscous oil is used to include those heavy oils and tars such as are commonly found in formations referred to as heavy oil or tar sands that have viscosities that are great enough to severely restrict the production of the oils from the formations in which they are found. The API gravity of such viscous oils is normally 20° API or less.

Figure 1:
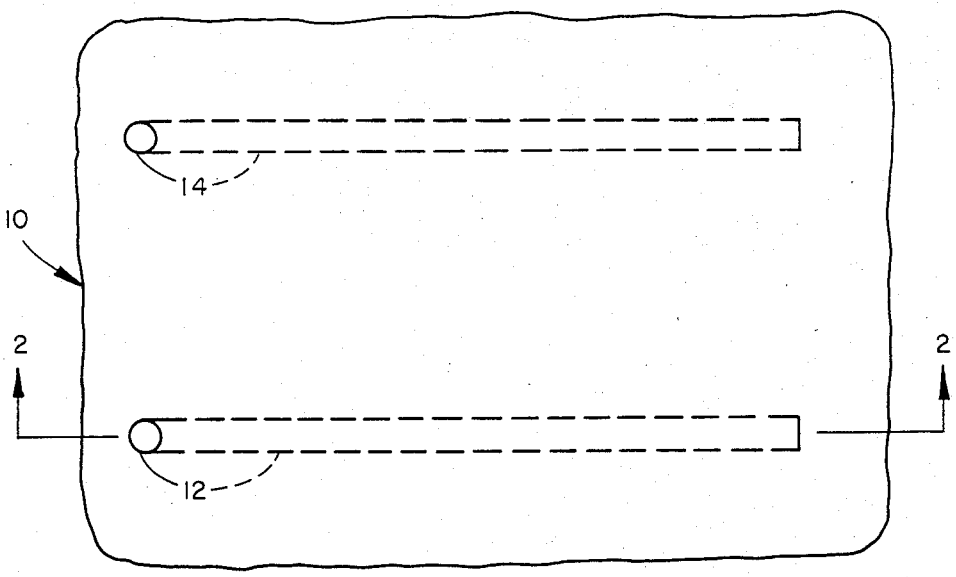
FIG. 1 is a diagrammatic plan view of an area which overlies an oil-containing formation, and it indicates by dotted lines an injection well and a production well which extend downwardly from the surface to the bottom of the oil-containing formation.
Figure 2:
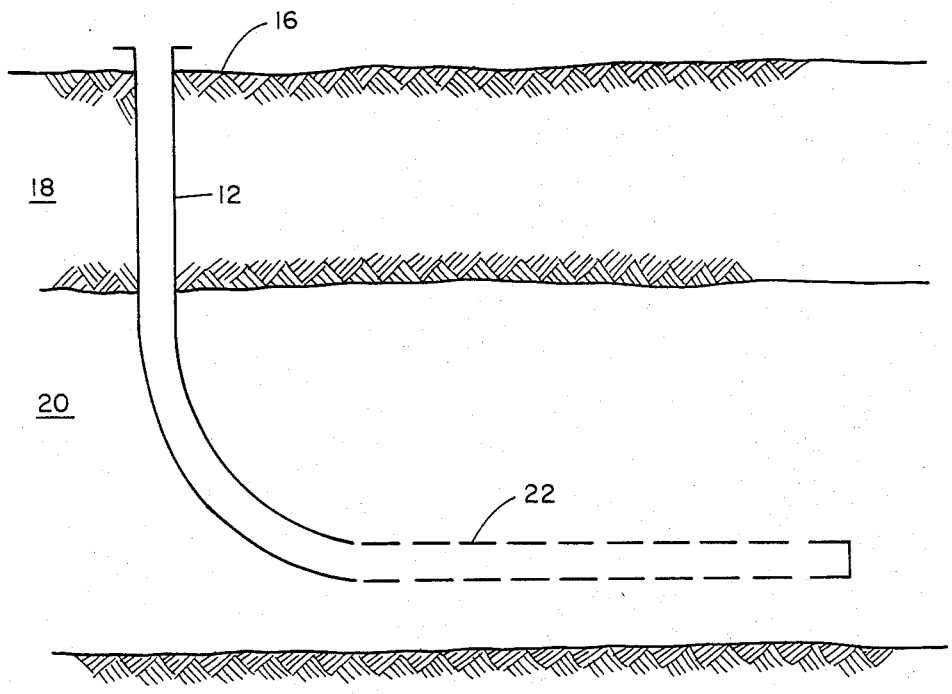
FIG. 2 is a sectional view through the area shown in FIG. 1 and it is taken along the plane indicated by the lines 2—2 in FIG. 1 showing the manner in which the injection well and production well penetrate the formation.
Figure 3:
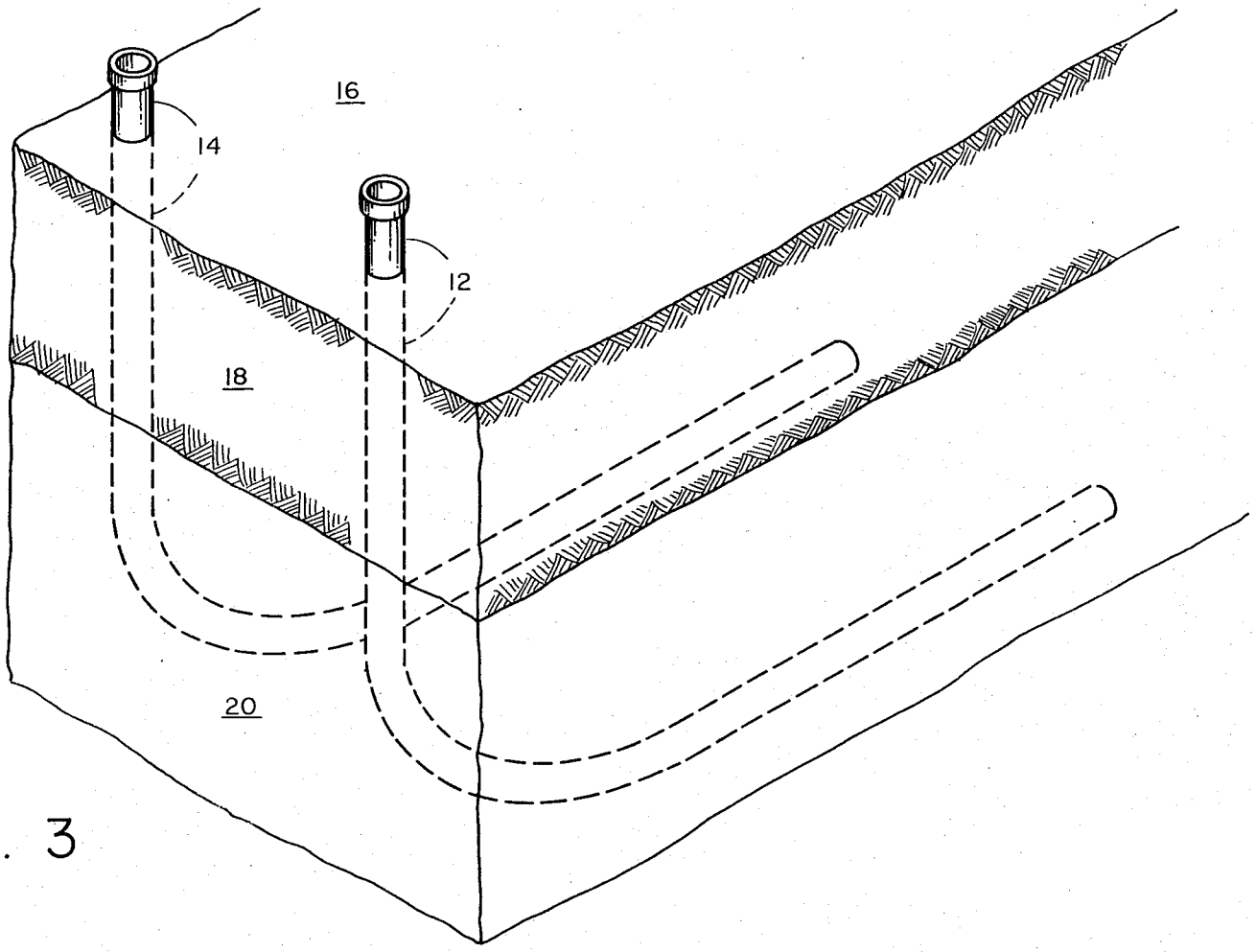
FIG. 3 is an isometric view of a rectangular block of the earth showing the position of the injection well and the production well within the formation.

Referring to FIG. 1, a field 10 overlying an oil-containing formation is provided with an injection well 12 and a production well 14. As shown in FIGS. 2 and 3, the injection well 12 and the production well 14 extend downwardly from the earth's surface 16, through an overburden 18, into the oil-containing formation 20 and then extend horizontally through the bottom of the formation. The production well 14 is spaced apart from the injection well 12 and the horizontal portion of the production well is at the same level and parallel to the horizontal portion of the injection well. The horizontally extending portion of the injection well 12 and the production well 14 have perforations 22 providing fluid communication between that portion of each well and the lower portion of the formation 20. Although only one injection well and one production well are shown for purposes of illustration, it is understood that a plurality of alternating spaced apart injection wells and production wells may be used in our process with the number depending upon the characteristics of the oil-containing formation. The wells may be formed by conventional directional drilling means with the horizontally extending portion of each well in the bottom of the formation being within plus or minus 20° degrees of a horizontal plane.

A predetermined amount of solvent having a specific gravity less than the specific gravity of the oil contained in the formation and having a viscosity not greater than 1/100 of the viscosity of the oil contained in the formation under formation conditions is injected into the bottom of the formation via the injection well 12 and fluid including oil is recovered from the formation via production well 14. The amount of solvent injected into the formation during this step is preferably within the range of 0.05 to 0.30 pore volume. Once this amount of solvent has been injected, the injection well 12 and the production well 14 are shut-in and the formation 20 is allowed to undergo a soak period for a predetermined time, preferably for a period of time between 2 to 20 days per foot of vertical thickness of the oil-containing formation. It will be recognized by those skilled in the art of oil recovery that during this shut-in or soak period minor amounts of fluid may be injected or produced, such as for the purpose of testing, without significant detrimental effects on the process. During this soak period, the liquid hydrocarbon solvent being lighter than the oil contained in the viscous oil-containing formation, that is, having a specific gravity less than the specific gravity of the oil contained in the formation and having a viscosity not greater than 1/100 of the viscosity of the oil contained in the formation under formation conditions, will tend to flow by gravity-driven convection upward into the oil-containing formation and the heavy oil will flow by gravity-driven convection downward to form a pattern of fingers. This fingering is important in that the distribution, size and extension of these fingers will provide intimate contact between the solvent and the heavy oil allowing the two to mix more effectively, thus forming a greater volume of oil that is reduced in viscosity and which can be produced more readily. This relatively low viscosity mixture can be much more effectively displaced from the reservoir than the original heavy oil by flooding the formation with water or suitable fluid, as is well known to those skilled in the art of petroleum engineering.

Once the soak period has been completed, a driving fluid is injected into the formation 20 via the injection well 12 and oil of reduced viscosity is recovered from the production well 14. The driving fluid displaces the mobilized oil from the formation 20 into the production well 14 and production is continued until the recovered oil contains an unfavorable amount of driving fluid, preferably at least 90 percent. The driving fluid for use in our invention may be gaseous or liquid. For example, gases include light aliphatic hydrocarbons having from one to four carbon atoms; carbon dioxide and nitrogen may be used for the process of our invention. Aqueous fluids are particularly preferred driving fluids in the process of our invention. Water, brine and thickened aqueous fluids are all suitable aqueous fluids for the purpose of our invention.

The hydrocarbon solvents used in our process must have a specific gravity less than that of the oil and less than that of the brine injected or naturally present in the formation and a viscosity not greater than 1/100 the viscosity of the oil contained in the formation under formation conditions. It is also highly desirable that the hydrocarbon solvent remain liquid under the temperature and pressure conditions that exist in the subsurface viscous oil-containing formation and not cause solids such as asphaltenes to precipitate from the oil in amounts sufficient to seriously plug the pores of the formation. The preferred hydrocarbon solvent is a light crude oil. Other examples of suitable hydrocarbon solvents include light oil condensates having an API gravity greater than 30 API degrees and partially refined tar which is generally known as syncrude. It may be desirable to include in the hydrocarbon solvent up to about 10 percent of aromatic material such as aromatic refinery stock to make the solvent compatible with the oil contained in the formations and to prevent the deposition of solid or gelatinous materials such as asphaltenes therefrom.

The viscous oil-containing subsurface formation to be treated by the present hydrocarbon solvent recovery method must be one that has no significant vertical permeability barriers in that portion of the formation to be treated. This allows the solvent that is injected into the lower portion of the formation between the injection well and production well to flow upward into the formation by convection forces thus solubilizing the oil and forming a solvent-oil mixture of reduced viscosity that can be more readily produced by a fluid drive process.

In a further embodiment, the injection well and the production well may extend downwardly from the earth's surface into the bottom of the oil-containing formation with the lower portion of each well extending through the formation at a downward angle not greater than 20° relative to a horizontal plane and the lower portion of each well in fluid communication with the formation. The production well is spaced apart from the injection well and the lower portion is at the same level and parallel to the lower portion of the injection well.

By the term "pore volume" as used herein, is meant that volume of the portion of the formation underlying the well pattern employed as described in greater detail in U.S. Pat. No. 3,927,716 to Burdyn et al., the disclosure of which is incorporated by reference.

What is claimed is:

1. A method of recovering viscous oil from a subterranean viscous oil-containing formation having no significant vertical permeability barrier therein comprising the steps of:

(a) providing at least one injection well extending downwardly from the earth's surface to the bottom of said oil-containing formation and then extending outwardly a substantial distance through said formation in a generally straight horizontal direction;

(b) providing at least one production well extending downwardly from the earth's surface to the bottom of said oil-containing formation and then extending outwardly a substantial distance through said formation in a generally straight horizontal direction;

(c) said production well being spaced from said injection well and the generally straight horizontal portion of said production well being generally at the same level as, and being generally parallel to, the generally straight horizontal portion of said injection well;

(d) said injection well and said projection well being in fluid communication with the formation over the distance of each well extending through said formation in a generally straight horizontal direction;

(e) injecting a predetermined amount of hydrocarbon solvent into the formation via said injection well, said solvent having a specific gravity less than the specific gravity of the oil contained in the formation and a viscosity not greater than 1/100 the viscosity of the oil contained in the formation under formation conditions and recovering fluids including oil from the formation via said production well;

(f) thereafter, shutting-in said injection well and said production well to permit said formation to undergo a soak period for a predetermined period of time wherein the solvent mixes with the oil in the formation by gravity-driven convection to reduce the viscosity of the oil; and (g) thereafter injecting a driving fluid into the formation via said injection well and recovering fluids including oil of reduced viscosity from said formation via said production well until the fluid being recovered from the production well comprises an unfavorable amount of driving fluid.

2. The method of claim 1 wherein the total amount of solvent injected during step (e) is between 0.05 and 0.30 pore volume and the soaking period during step (f) is for a period of time between 2 and 20 days per foot of vertical thickness of the oil-containing formation.

3. The method of claim 1 wherein the driving fluid injected during step (g) is a gaseous material selected from the group consisting of carbon dioxide, nitrogen or aliphatic hydrocarbons having one to four carbon atoms.

4. The method of claim 1 wherein the driving fluid injected during step (g) is water.

5. The method of claim 1 wherein said hydrocarbon solvent is selected from the group consisting of a light crude oil having an API gravity greater than 30 API degrees and a light crude oil product generally known as syncrude.

6. The method of claim 1 wherein production of fluids from the formation by the production well according to step (g) is continued until the fluid recovered contains at least 90 percent driving fluid.

7. The method of claim 1 wherein the outwardly extending straight horizontal portion of the injection well and production well is at an angle not greater than plus or minus 20 degrees relative to a horizontal plane through the formation.

* * * * *